US005135016A

United States Patent [19]

Stiller

[11] Patent Number: 5,135,016

[45] Date of Patent: Aug. 4, 1992

[54] FOLDING UMBRELLA FRAME GUIDE STRUCTURE

[75] Inventor: Klaus Stiller, Langenfeld, Fed. Rep. of Germany

[73] Assignee: Kortenbach Verwaltungs-und Beteiligungsesellschaft mbH & Co., Soligen, Fed. Rep. of Germany

[21] Appl. No.: 658,884

[22] Filed: Feb. 22, 1991

[30] Foreign Application Priority Data

Jan. 16, 1991 [DE] Fed. Rep. of Germany ..... 4101069

[51] Int. Cl.[5] ..... A45B 19/00

[52] U.S. Cl. ..... 135/25.3; 135/31; 135/27

[58] Field of Search ..... 135/25.3, 25.31, 25.32, 135/25.33, 25.34, 26, 27, 29, 31

[56] References Cited

U.S. PATENT DOCUMENTS 1,020,236 3/1912 Ward ..... 135/25.31
1,083,050 12/1913 Bialozyt ..... 135/31 X
3,744,504 7/1973 Weber ..... 135/26
3,780,748 12/1973 Weber ..... 135/25.3
4,676,262 6/1987 Yang ..... 135/25 R
4,739,783 4/1988 Yang ..... 135/25 R
4,934,395 6/1990 Wu ..... 135/25.3
4,966,180 10/1990 Lai ..... 135/25 R

FOREIGN PATENT DOCUMENTS 143761 11/1990 Taiwan .

*Primary Examiner*—David A. Scherbel
*Assistant Examiner*—Lan Mai
*Attorney, Agent, or Firm*—Samuel Meerkreebs

[57] ABSTRACT

The invention relates to a collapsible umbrella having at least one pair of canopy rod parts (1,2), which extend alongside one another and are guided so as to be displaceable on one another, within each linkage of the canopy-supporting linkage frame. One of the canopy rod parts (2) is composed of wire, and guided on the other rod part (1) by means of a bight (2*e*) of the wire which embraces the other rod part and is formed with hooks (2*f*,2*g*) which can be spread to allow the bight to be fitted transversely on the other rod.

6 Claims, 3 Drawing Sheets

FIG. 3
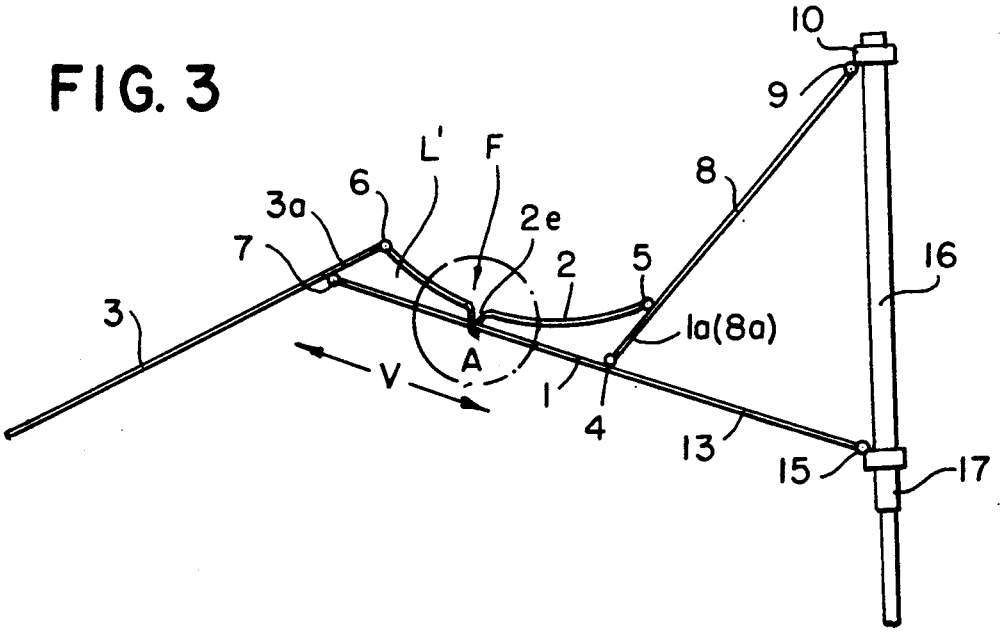
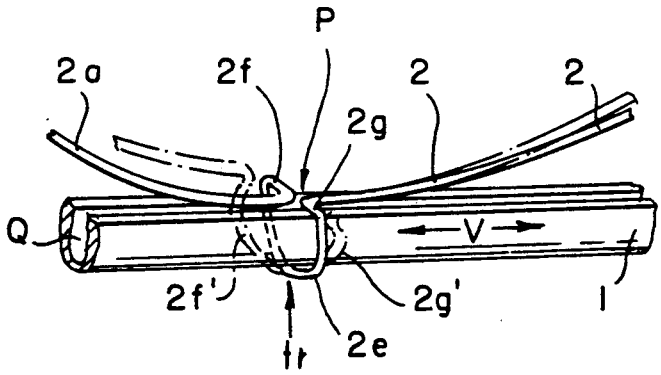
FIG. 4
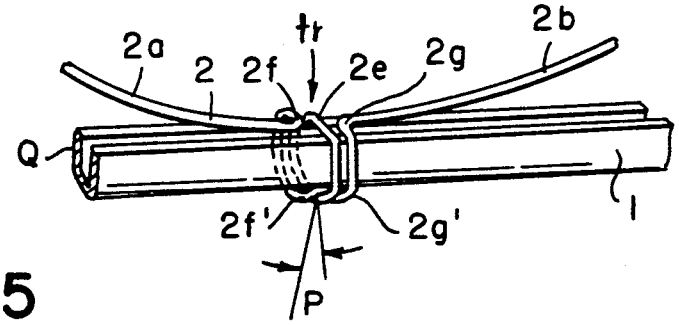
FIG. 5
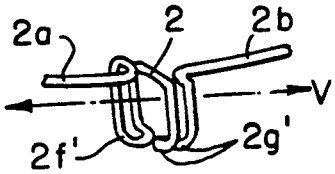
FIG. 6

FOLDING UMBRELLA FRAME GUIDE STRUCTURE

BACKGROUND OF THE INVENTION

1. Field of the Invention

The invention relates to a folding umbrella comprising a canopy-supporting framework with a plurality of linkages each including a pair of rod parts which extend alongside one another and are guided for relative longitudinal displacement by an integral bent part of one of the rod parts, which rod part is made of wire, engaging around the other rod part. Such a frame is hereinafter referred to as of the kind described.

2. Description of Related Art

An umbrella of this general character is known, for example, from U.S. patent specification No. 4,966,180 and from Taiwan UM Publication 143761. In both cases, two canopy rod parts, which extend approximately parallel to one another and which are guided so as to be displaceable on one another, form the long links of a lever parallelogram. Of the latter, the control link is made of thin wire for the purpose of achieving an optimally thin or small dimensioned folded structure of the closed umbrella and, moreover, a helix is also additionally formed in the wire, by means of which the control link is supported so as to be displaceable on the more stable parallel link. In U.S. Pat. No. '180, the helix is shown as a loose coil whereas, according to the TW '761, it is constructed as a multi-turn coil. In both cases, the coil serves not only for supporting and stabilising on the parallel link the unstable thin control link which is nevertheless considerably stressed in terms of compression and tension, but also, for reasons of saving costs, for dispensing with a separate specific guide element, such as is represented, for example, as a bush guide in FIG. 1 of the U.S. Pat No. '180, for example, as shown in U.S. patent specifications Nos. 4,739,783 (FIG. 4) or 4,676,262 (FIG. 5).

In particular the guide according to the latter cited patent specification likewise does not require a separate part as a result of a material squeezing of the profile of the parallel link, which squeezing encloses the thin control link in a displaceable manner. However, since this squeezing causes an undesired weakening of this link, this variant of a support and guide of the unstable control link is not practical. However, the supports and guides described above by means of the coil according to U.S. Pat. No. '180 and TW '761 respectively are also not practical. On the one hand, the unstable control link made of thin wire is intended to be supported with the aid of these guides for the purpose of stabilisation and in order to maintain the required rigidity against tensile and compression stresses. At the same time, the supporting guide is to be of an optimally inexpensive and simple design with the aid of the coil. However, this coil acts counter to the latter and in a counter-productive manner since, by nature, they act as a coil spring to damp and destroy the tensile and compression force in a linear manner and thus, at least to a considerable extent, do not transmit the tensile and compression forces acting at one end of the control link. Accordingly, the entire function of the umbrella is in doubt.

SUMMARY OF THE INVENTION

The underlying object of the invention is to provide a remedy in this respect and to improve an umbrella frame of the kind described in such a way that, in particular, the guide of the unstable wire canopy rod part on the other canopy rod part is of optimally rational design but, at the same time, the actual function of the guided rod part is not impeded and, moreover, this part can also easily be assembled and dismantled in a simple manner.

According to the invention, this object is achieved the by the expedient that the bend in the wire rod part is a bight which embraces the other rod part and terminates in opposed hooks which secure the bight on the other rod part but which can be spread apart to enable the other rod part to pass transversely between the hooks for assembling and disassembling the two rod parts.

By this means, a folding umbrella of a practical design is provided which allows the inherently unstable guided rod part made of wire to be supported on the guiding generally parallel rod part in a manner appropriate to its function and also to guide it directly thereon by means of the bight without impeding the compression and tensile functions, and also to assembly and dismantle it simply with few manipulations. By means of the bight, the guided unstable canopy rod part can be clipped onto the guiding rod part simply transversely to the length of the guiding rod part.

The bight then acts as a clip or retaining claw. It surrounds the cross-sectional profile of the guiding stable rod part securely and captively with the required displacement clearance transversely to the longitudinal direction of the rods and also non-resiliently in this longitudinal direction. Consequently, the guided unstable rod part receives the necessary secure support and stabilisation on the guiding parallel rod part and thus also the required rigidity against compression and tensile stresses, with the result that the compression and tensile forces acting on the guided rod part can no longer be absorbed therein, but are transmitted in a manner appropriate to the function.

An advantageous snap-type attachment and fastening of the bight results if the bight is constructed of spring wire whereby the hooks form spring jaws which can be spread resiliently apart for clipping the bight onto the other rod part.

The bight may be bent so that the parts of the wire rod part on each side of the bight lead from a mid part of the bight between the jaws.

A design of the bight, which is inherently particularly rigid against compression and tensile stresses, results according to a further variant of the invention in which the other rod part has a channel-shaped cross section into which the hooks engage.

Alternatively the hooks might engage around one another.

In the further construction the bight is constructed as a double ring interconnected by a straight bridge.

The invention is explained in greater detail below with reference to several examples illustrated in the accompanying drawings, in which:

BRIEF DESCRIPTION OF THE DRAWING

FIG. 3 is a diagrammatic, semi-sided diagram of a frame constructed according to the invention in a half opened position;

FIG. 4 shows an enlarged illustration of the detail from section A of FIG. 3 with one example of the bight guide according to the invention;

FIG. 5 is an enlarged illustration of a second example of the bight guide;

FIG. 6 shows the bight guide according to FIG. 5 separately;

The folding umbrella can be of any design having a canopy-supporting framework with linkages which can be collapsed in a twofold or multiple manner and in which there are at least two canopy rod parts 1 and 2, which extend parallel or approximately parallel to one another and are displaceable on one another. For example, in the form of canopy rods, struts or other lever elements.

Of the two canopy rod parts, part 1 can be the guiding rod part which is stable and is composed, for example, of a rail having a U-shaped profile Q; see FIG. 4. The rod part 2 which is guided so as to be displaceable on the part 1 is composed of thin steel wire in order to give the linkage of the umbrella canopy an optimally flat profile in the opened, extended position and also in the folded shortened position, and therefore also to be able to make the umbrella with as large a canopy circumference as possible into a collapsed bundle with as slim a structure as possible. On the other hand, however, the thin steel wire, taken on its own, is too unstable. It lacks the required rigidity against compression stress for the collapsing and folding function in the umbrella canopy. Therefore, the guided rod part 2 in the known umbrellas of this design is supported by a displaceable guide F on the parallel rod part 1. This also results in the sub-division of the guided rod part 2 into two more stable parts of reduced size or halves 2*a* and 2*b* on both sides of the guide F. In the known umbrella frame of this design, this is formed, for example, by a bush or by a tab pressed into the U-shaped profile of the guiding rod part 1 or by a bend in the form of a coil wound around the guiding rod part 1 and formed on the rod part 2.

Figure 1:
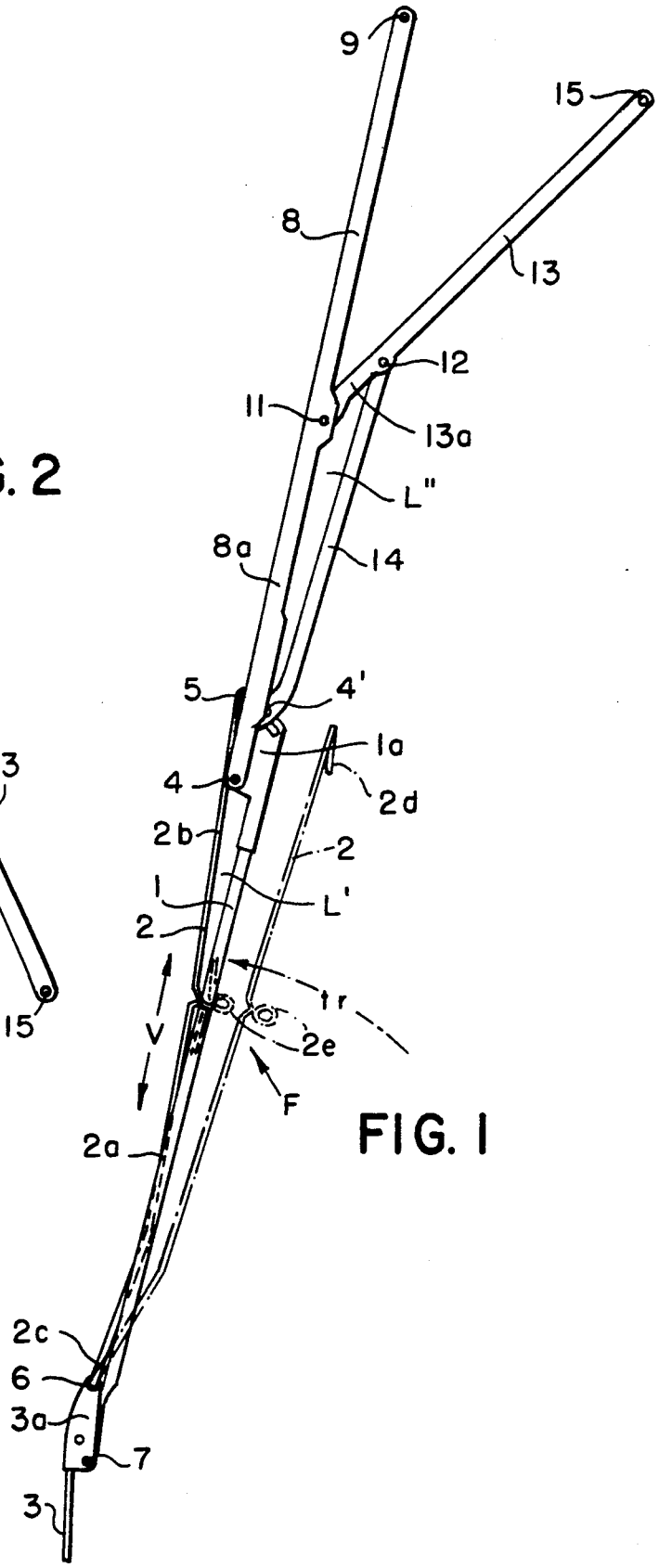
FIG. 1 shows a canopy linkage, which can be shortened in a threefold manner, of a frame according to the invention, in an extended position.
Figure 10:
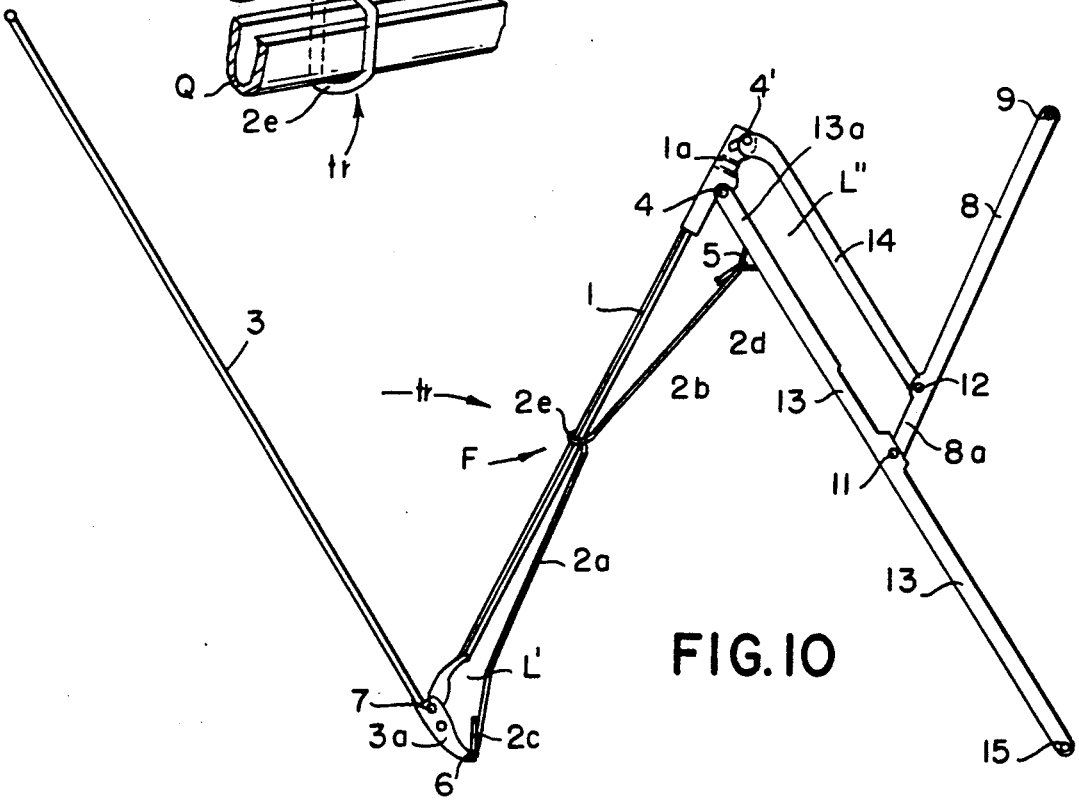
FIG. 10 shows a linkage, which can be folded in a threefold manner, with a reversed bight guide.

For reasons of clarity, only one linkage of the canopy-supporting framework is shown in the drawing. The rod parts 1 and 2 can be used in conjunction with any desired lever and thrust mechanisms. Referring to FIG. 3 for example, they can form the long links of a lever parallelogram L' in conjunction with two short lever arms 1*a* and 3*a* or 3*a* and 8*a* or 3*a* and 13*a*. The lever arm 3*a* is part of an outer canopy rod 3. The parts 1,2,1*a* and 3*a* or 3*a* and 8*a* or 3*a* and 13*a* are connected to each other by joints 4,5,6 and 7. Linked to the joint 4 is a canopy rod 8 (FIG. 1,2,3) or a strut 13 (FIG. 10). The canopy rod 8 is linked by means of a further joint 9 to a crown 10 of the umbrella frame and the strut 13 is connected by means of a joint 15 to a slide 17 which is displaceable on the a stick 16.

Figure 2:
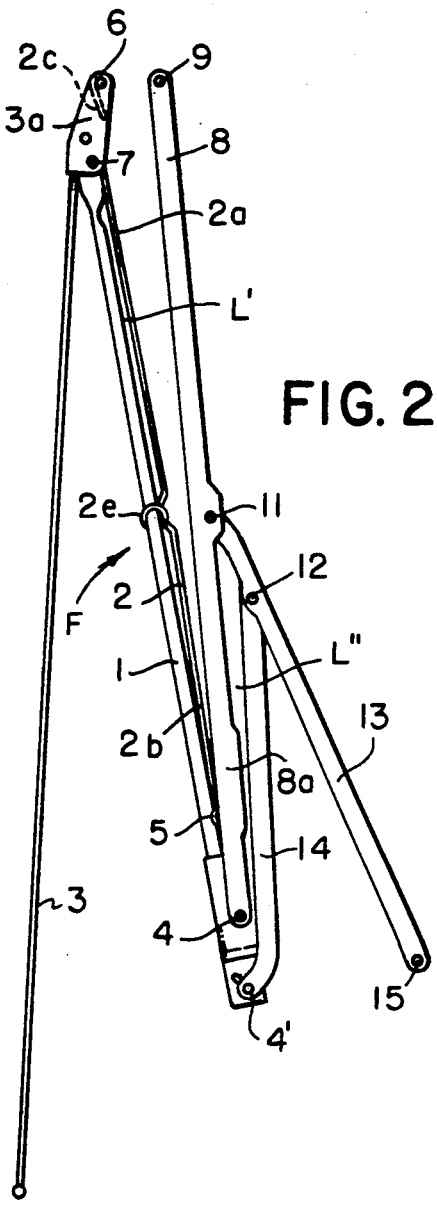
FIG. 2 shows the same linkage in an almost completely folded position.

Accordingly, in the example shown in FIG. 3, the short lever arm 1*a* is a section of the canopy rod 8 and the guiding canopy rod part 1 is a section of the strut 13. In contrast, in the variant according to FIGS. 1 and 2 the short lever arm 1*a* is a section of the guiding canopy rod part 1 and, at the same time, a control link of the lever parallelogram L' and of a lever parallelogram L'' acting adjacent to the latter. The lever parallelogram L'' extends between the joints 4,4' and 11 and 12 and is formed by the short lever arm 1*a*, by the section 8*a* of the canopy rod 8, by a control rod 14 and by a short lever arm 13*a* of the strut 13. Consequently, according to FIGS. 1 and 2 the short lever arm 8*a* of the canopy rod 8 and the control rod 14 form the long links of the lever parallelogram L'' and thus also, in turn, a pair of canopy rod parts which extend parallel or approximately parallel to one another and which could also be guided and supported so as to be displaceable on one another with the aid of a guide F even if the control rod 14 were to be composed of thin steel wire like the canopy rod part 2.

As is visible in FIG. 10, the canopy-supporting framework of an umbrella frame having at least two canopy rod parts 1 and 2, which extend parallel or approximately parallel to one another and are guided on one another, and having the construction which can be shortened in a single, twofold or multiple manner having a lever parallelogram L' or two such parallelograms L' and L'' can also be reversed in its kinematics. Whereas, according to the variants according to FIGS. 1, 2 and 3, the guiding rod part 1 is the control rod of the lever parallelogram L' and the guided rod part 2 is the parallel link located above it, according to the kinematics of FIG. 10, the guided canopy rod part 2 is the control rod in a corresponding arrangement below the guiding rod part 1. Correspondingly, in this kinematic system, the control rod 14 is an upper canopy rod.

As is further known per se, the guided rod part 2 can have at one or at both ends a bent hook 2*c*,2*d* and, with the aid of hook, it can be hooked detachably in holes of the joints 5 or 6 or 5 and 6. As is likewise known, the holes of the joints can be designed as projecting loops, such as, for example, the hole on joint 5. The joint 4' between the short lever arm 1*a* or 3*a* and the control rod 14 can likewise be a pin-slot connection which is known per se.

The guide F of the canopy rod part 2 does not have the form of a coil, but the form of a bight 2*e* or 2*e'* formed in part 2, by means of which the part 2 can be clipped onto the guiding rod part 1 transversely to its length V in accordance with the arrow tr. This can take place before the rod part 2 has been hooked into the joint holes or joint loops 5 or 6 by means of one of the hooks 2*c* or 2*d* or after it has been appropriately hooked on. As is visible in FIG. 4, the guided rod part 2 is thereby placed on the rod part 1 at the loop 2*e* in the direction of the arrow tr transversely to the mutual displacement V and it then effectively surrounds the cross-section of profile Q of the rod part 1 captively in the manner of a ring. For this purpose, opposed hooks 2*f*,2*g* are formed on the bight 2*e* or 2*e'*, which hooks secure the ring-like bights 2*e* or 2*e'* around the cross-sectional profile Q after it has been clipped on at the through-passage P of the bight onto the profile Q.

The bight 2*e* can be designed as a ring which can be spread apart in the form of a spring clip, it being possible for spring jaws 2*f'*,2*g'* to provide the securing hooks 2*f*,2*g*, which spring jaws open and close in the manner of tongs at the through-passage P (FIG.4,8).

In accordance with the variant according to FIGS.5 and 6, the ring-like bight 2e around the cross-sectional profile Q can be designed in such a way that the bight 2e is closed at the point where it branches into the two ends 2a,2b of the canopy rod part 2, that is to say above the cross-sectional profile Q, and then has the spring jaws 2f',2g' below. The latter open and close below the cross-sectional profile Q, and, correspondingly, the through-passage P which can be expanded for attaching the loop 2e also lies at the part of the bight 2e remote from the two ends 2a,2b.

Figure 7:
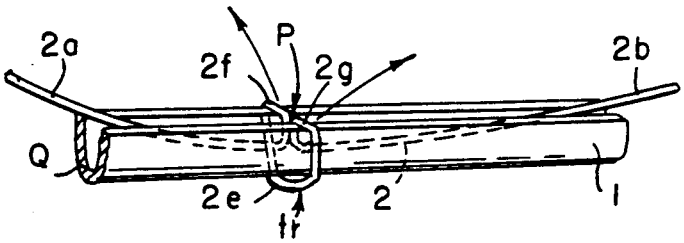
FIG. 7 is an enlarged illustration of a third example of the bight guide.

As is visible from the variant according to FIG.7, the bight 2e with the securing hooks 2f,2g can also be supported and guided inside the cross-sectional profile Q in a particularly effective manner in terms of resistance to tensile and compression stresses and, at the same time, it can also guide the ends 2a,2b of the canopy rod part 2 inside the profile Q by the securing hooks 2f,2g being bent down inside the profile.

Figure 8:
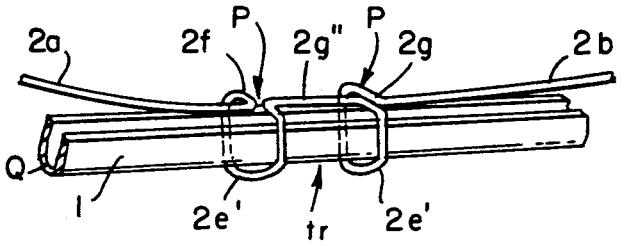
FIG. 8 is an enlarged illustration of a fourth example of the bight guide.

In the exemplary embodiments of the canopy rod 2 described above, the latter is subdivided by the bight 2e,2e into two linear parts corresponding to the lengths of its ends 2a,2b. According to the exemplary embodiment of FIG.8, a threefold linear subdivision of the rod part 2 can be achieved if the loop 2e is designed as a double ring 2e', in between a straight bridge 2g'' is formed. The threefold linear subdivision of the canopy rod 2 and the double support and stabilisation of the latter, which is thus achieved in a manner resistant to compression stresses, results from the substantially straight configurations of 2a,2g'' and 2b.

Figure 9:
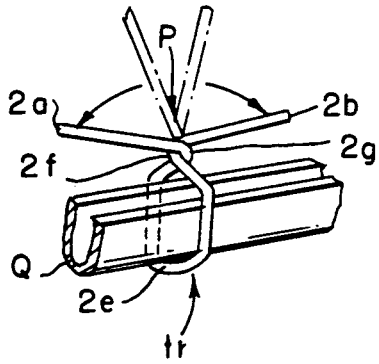
FIG. 9 is an enlarged illustration of a fifth example of the bight guide.

In accordance with the example of FIG.9, a spring wire structure results for the canopy rod part 2 with a loop 2e, in which the separating line or through-passage P is completely blocked after the bight 2e has been attached to the rod part 1, by the securing hooks 2f,2g engaging one another flexibly in a hooked manner. The through-passage P is produced by the hooks 2f,2g coming out of engagement owing to bending the two ends 2a,2b upwards counter to the spring force of the loop 2e and its hooks 2f,2g. Owing to the through-passage P which is then exposed between the hooks 2f,2g, the loop 2e can be clipped onto the cross-sectional profile Q and, as soon the ends 2a,2b are released again, the hooks 2f,2g as the ends 2a,2b are released again, the hooks 2f,2g spring back into their engaged position.

I claim:

1. In a folding umbrella comprising a canopy-supporting framework with a plurality of linkages each including a pair of rod parts which extend alongside one another and are guided for relative longitudinal displacement by an integral bent portion of one of said pair of rod parts, which one rod part is made of wire and engages around the other rod part; characterized in the bent portion in the one rod part made of wire is a bight which embraces the other rod part and terminates in opposed hooks which secure the bight on the other rod part and which can be spread apart to enable the other rod part to pass transversely between the hooks for assembling and disassembling the pair of rod parts, said bight being constructed of spring wire and comprising opposed portions defining jaws; said jaws being disposed in a flanking relation to the other rod part from opposite sides, said jaws being resiliently spreadable apart for removably clipping the bight onto the other rod part.

2. A folding umbrella according to claim 1, wherein said bight is bent so that the parts of the wire rod part on each side of the bight lead from a mid part of the bight between the jaws.

3. A folding umbrella according to claim 1, wherein said second rod part has a channel-shaped cross section into which the hooks engage.

4. A folding umbrella according to claim 1, wherein said hooks engage around one another.

5. A folding umbrella according to claim 1, wherein said bight is constructed as a double ring interconnected by a straight bridge.

6. A folding umbrella having a canopy supported by a frame according to claim 1.

* * * * *